US006161270A

United States Patent [19]

Ghosh et al.

[11] Patent Number: 6,161,270

[45] Date of Patent: Dec. 19, 2000

[54] MAKING PRINTHEADS USING TAPECASTING

[75] Inventors: Syamal K. Ghosh; Dilip K. Chatterjee, both of Rochester; Edward P. Furlani, Lancaster; James K. Lee, Rochester, all of N.Y.

[73] Assignee: Eastman Kodak Company, Rochester, N.Y.

[21] Appl. No.: 09/240,752

[22] Filed: Jan. 29, 1999

[51] Int. Cl.[7] ..... H04R 17/00

[52] U.S. Cl. ..... 29/25.35; 29/890.1; 29/527.2; 29/527.5; 310/333

[58] Field of Search ..... 29/25.35, 890.1, 29/527.2, 527.5; 310/333, 345, 363; 205/127, 300, 301; 264/56, 63

[56] References Cited

U.S. PATENT DOCUMENTS

| | | | |
|---|---|---|---|
| 4,504,340 | 3/1985 | Tummala et al. | 156/89 |
| 5,028,937 | 7/1991 | Khuri-Yakub et al. . | |
| 5,227,813 | 7/1993 | Pies et al. . | |
| 5,248,998 | 9/1993 | Ochiai et al. . | |
| 5,311,218 | 5/1994 | Ochiai et al. . | |
| 5,351,375 | 10/1994 | Ochiai et al. | 29/25.35 |
| 5,359,760 | 11/1994 | Busse et al. | 29/25.35 |
| 5,365,645 | 11/1994 | Walker et al. . | |
| 5,421,071 | 6/1995 | Kanegae et al. | 29/35.35 |
| 5,485,663 | 1/1996 | Ochiai et al. | 29/25.35 |
| 5,581,861 | 12/1996 | Lee et al. | 29/25.35 |
| 5,590,451 | 1/1997 | Katsuumi et al. | 29/25.35 |
| 5,598,196 | 1/1997 | Braun . | |
| 5,600,357 | 2/1997 | Usui et al. . | |
| 5,650,810 | 7/1997 | Muto | 347/71 |
| 5,688,391 | 11/1997 | Hayes . | |
| 5,697,144 | 12/1997 | Mitani et al. | 29/611 |
| 5,725,825 | 3/1998 | Hotomi et al. | 264/434 |
| 5,758,396 | 6/1998 | Jeon et al. | 29/25.35 |
| 5,809,646 | 9/1998 | Reineckle et al. | 29/890.1 |
| 5,818,479 | 10/1998 | Reineckle et al. | 347/47 |
| 5,820,771 | 10/1998 | Burke et al. | 216/27 |
| 5,904,892 | 5/1999 | Holmes | 264/650 |
| 5,924,197 | 7/1999 | Murakami et al. | 29/890.1 |

FOREIGN PATENT DOCUMENTS

| | | |
|---|---|---|
| 0 827 833 | 3/1998 | European Pat. Off. . |

*Primary Examiner*—Carl J. Arbes
*Assistant Examiner*—Minh Trinh
*Attorney, Agent, or Firm*—Raymond L. Owens

[57] ABSTRACT

A method of making a printhead includes forming a channel member by providing a mold having a top portion having peaks and valleys and by tape casting a slurry of piezoelectric material into the mold and onto the peaks and valleys of the top portion of the mold to form a tape cast member having a bottom surface with peaks and valleys and a flat top surface and removing the tape cast member. After removing the tape cast member, the top surface of the tape cast member is embossed so as to provide peaks and valleys in opposite sides of the tape cast member wherein the valleys in the top surface are disposed in an offset relationship to the peaks in the bottom surface. Thereafter, the embossed tape cast member is poled to align the electrical dipoles within the piezoelectric material; and a coating of conductive material is formed over the top and bottom surfaces of the tape cast member and then cutting grooves through conductive coating into the top surface in the valleys of the tape cast member to form a channel member. Finally, an orifice plate is provided over top surface of the channel member and a substrate over the bottom surface of the channel member.

3 Claims, 4 Drawing Sheets

MAKING PRINTHEADS USING TAPECASTING

FIELD OF THE INVENTION

This invention relates to a method of manufacturing ink jet printheads. This invention relates, in particular, to tape casting of piezoelectric ceramic in conjunction with embossing to form micro-sized ink channels used in printheads.

BACKGROUND OF THE INVENTION

An ink jet printhead made from a piezoelectric material is used to selectively eject ink droplets onto a receiver to form an image. Within the printhead, the ink may be contained in a plurality of channels and energy pulses are used to actuate the printhead channels causing the droplets of ink to be ejected on demand or continuously, through orifices in a plate in an orifice structure.

In one representative configuration, a piezoelectric ink jet printing system includes a body of piezoelectric material defining an array of parallel open topped channels separated by walls. In the typical case of such an array, the channels are micro-sized and are arranged such that the spacing between the adjacent channels is relatively small. The channel walls have metal electrodes on opposite sides thereof to form shear mode actuators for causing droplets to expel from the channels. An orifice structure comprising at least one orifice plate defining the orifices through which the ink droplets are ejected, is bonded to the open end of the channels. In operation of piezoelectric printheads, ink is directed to and resides in the channels until selectively ejected therefrom. To eject an ink droplet through one of the selected orifices, the electrodes on the two side wall portions of the channel in operative relationship with the selected orifice are electrically energized causing the side walls of the channel to deflect into the channel and return to their normal undeflected positions when the applied voltage is withdrawn. The driven inward deflection of the opposite channel wall portions reduces the effective volume of the channel thereby increasing the pressure of the ink confined within the channel to force few ink droplets, 1 to 100 pico-liters in volume, outwardly through the orifice. Operation of piezoelectric ink jet printheads is described in detail in U.S. Pat. Nos. 5,598,196; 5,311,218; 5,365,645, 5,688,391, 5,600, 357, and 5,248,998.

The use of piezoelectric materials in ink jet printheads is well known. Most commonly used piezoelectric material is lead-zirconate-titanate, (PZT) ceramic which is used as a transducer by which electrical energy is converted into mechanical energy by applying an electric field across the material, thereby causing the piezoelectric ceramic to deform.

Under previous methods of making piezoelectric ink jet printheads, a block of piezoelectric ceramic such as PZT in which channels are to be formed is poled, to make the material piezoelectrically deflectable or "active", by imparting a pre-determined voltage widthwise across the piezoelectric ceramic block in a selected poling direction of the internal channel side wall sections later to be created in the poled ceramic body section by forming a spaced series of parallel grooves therein. These grooves are generally formed by sawing, laser cutting or etching process. This current process of poling a bulk ceramic and later fabricating micro-sized channels by sawing or other processes is discussed in details in the U.S. Pat. Nos. 5,227,813, and 5,028,937, and EP 827833. This process of forming channels is not only time consuming and expensive, but also is amenable to many defects generated during cutting the channels thereby reducing the throughput and increasing the unit manufacturing cost. Furthermore, mechanical damages caused during sawing or laser cutting also are detrimental to the piezoelectric characteristics of the material.

SUMMARY OF THE INVENTION

It is an object of the present invention to provide a method of making piezoelectric ceramic ink jet printhead which will eliminate time consuming and costly processes of cutting channels.

These objects are achieved in a method of making a printhead comprising the steps of:

(a) forming a channel member by providing a mold having a top portion having peaks and valleys:

(i) tape casting a slurry of piezoelectric material into the mold and onto the peaks and valleys of the top portion of the mold to form a tape cast member having a bottom surface with peaks and valleys and a flat top surface;

(ii) removing the tape cast member;

(iii) embossing the top surface of the tape cast member so as to provide peaks and valleys in opposite sides of the tape cast member wherein the valleys in the top surface are disposed in an offset relationship to the peaks in the bottom surface;

(iv) polling the embossed tape cast member to align the electrical dipoles within the piezoelectric material; and (v) forming a coating of conductive material over the top and bottom surfaces of the tape cast member and then cutting grooves through conductive coating into the top surface in the valleys of the tape cast member to form a channel member; and (b) providing an orifice plate over top surface of the channel member and a substrate over the bottom surface of the channel member.

In accordance with the present invention a method is disclosed of forming a series of micro-sized channel members in the green stage of ceramic processing by tape casting, and followed by embossing another series of parallel channels on the opposite side of the tape cast piezoelectric ceramic member in a manner such that the embossed channels are placed in the space between the tape cast channels. This arrangement facilitates the polling of the piezoelectric channel members. It also eliminates time consuming and batch saw processing.

DETAILED DESCRIPTION OF THE PREFERRED EMBODIMENT

The present invention provides a method of making ink jet piezoelectric printheads using tape casting ceramic slurry and embossing tape cast member to form a series of closely spaced micro-sized parallel channels on both sides of the tape cast member. The channel members are then poled, electrically conductive electrodes are formed on both surfaces and top channels are cut with a saw or other means to physically separate the electrodes on both side walls of each channel. The open end of the ink channels are covered with an orifice plate and the other end is mounted on a substrate.

Figure 1A:
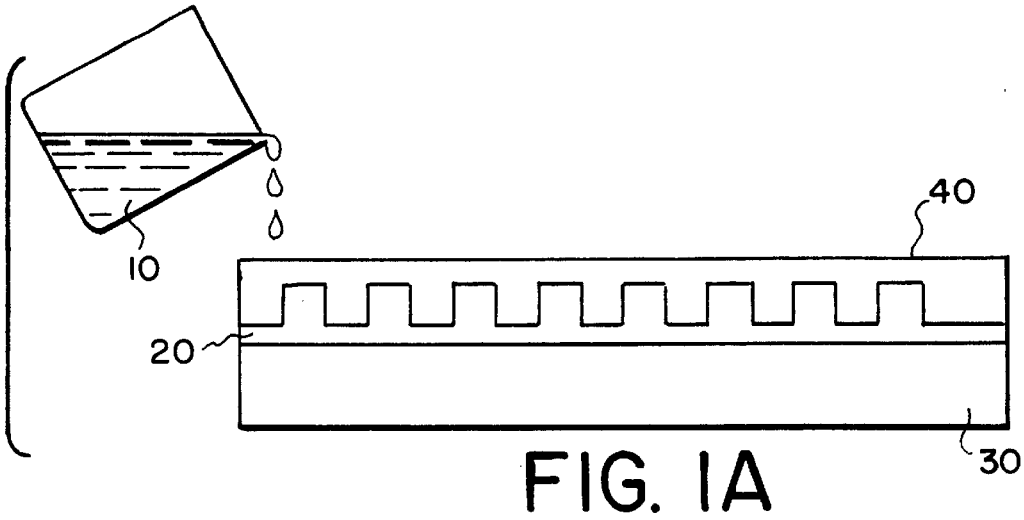
FIGS. 1*a–c* are schematics of forming ceramic channel members by tape casting and embossing.
Figure 1B:
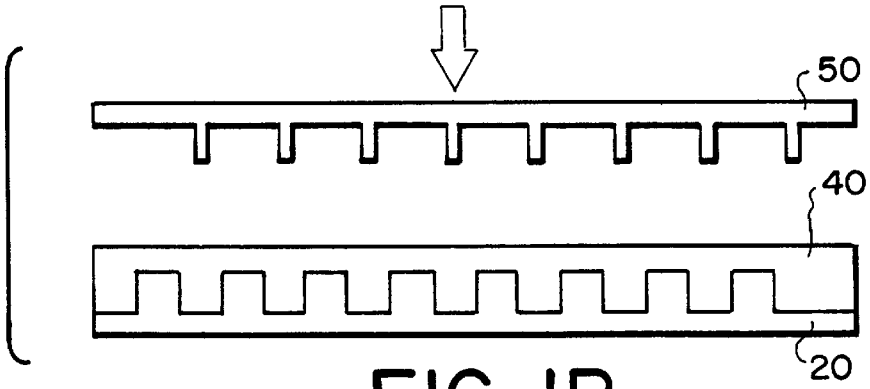
Figure 1C:
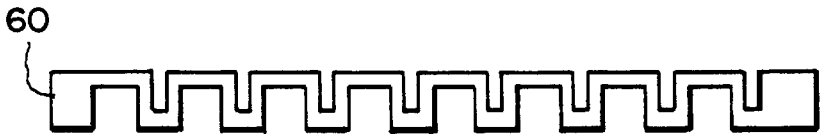

Referring to FIGS. 1*a–c,* a schematic representation of making piezoelectric ceramic channel member is illustrated. In FIG. 1*a,* a tape casting process in which a ceramic slurry 10 comprising lead-zirconate-titanate having chemical composition $Pb(Zr_2Ti_{1-z})O_3$, where z=0.52 to 0.55, and multi-component organic additives. The additives include a binder, a plasticizer, a dispersant/wetting agent and an antifoaming agent, which are poured into a mold 20 held on a platen 30 to form a tape cast member 40. Tape cast member 40 has a flat top surface. Examples of organic binders which can be used in the formation of ceramic slurry for tape casting are polyvinyl alcohol, polyvinyl acetate, polyvinyl chloride, polyvinyl butryal and polystyrene. The preferred dispersant and/or wetting agent used in the formation of ceramic slurry 10 is isooctylphenylpolyethoxyethanol. The preferred defoaming agent used in the formation of ceramic slurry 10 is tributylphosphate. The following is a preferred specific formulation of the ceramic slurry 10:

| | |
|---|---|
| Lead-zirconate-titanate powder | 100 g. |
| Methyl ethyl ketone/ethanol 50:50 mixture (solvent) | 25 g. |
| Menhaden fish oil (dispersant) | 0.8 g. |
| Polyethylene glycol (plasticizer) | 7.5 g. |
| Polyvinyl alcohol (binder) | 15 g. |
| Trinutylphosphate (defoaming agent) | 1.5 g. |
| Isooctylphynylpolyethoxyethanol (wetting agent) | 1 g. |

A particularly useful Menhaden fish oil that was used was Deflock D-3 ™ as produced by Spencer Kellogg, Inc. of Buffalo, New York.

The ceramic powder, methyl ethyl ketone/ethanol 50:50 mixture, and Menhaden fish oil were added to a ball mill and milled for at least six hours to achieve thorough mixing. The resulting ball milled mixture was then placed in a mixer and mixed with the remaining ingredients listed above for at least twelve hours. The resulting ceramic slurry 10 was then allowed to age for at least twelve hours and subsequently de-aired. Viscosity of the ceramic slurry 10 was checked and was maintained at 1000 to 1200 MPa. The ceramic slurry 10 was then cast into a moving carrier mold 20 made of materials selected from cellulose acetate, steel, aluminum or other metals, and spread to a controlled and predetermined thickness with the edge of a doctor blade to form the tape cast piezoelectric green ceramic member 40. After the casting process, most of the solvent in the green ceramic member 40 was evaporated away slowly by flowing air over the cast green ceramic member 40. The next step of the invention illustrated in FIG. 1*b,* involves removing the dry tape cast piezoelectric green ceramic member 40 along with the mold 20 from the platen 30 of the tape casting machine and transferring to the embossing station shown in FIG. 1*b.* In accordance with the present invention, embossing the top surface 40*a* of the tape cast green ceramic member 40 provides peaks and valleys wherein the valleys in the top surface 40*a* are disposed in an offset relationship (See FIG. 1*c*) to the peaks in the bottom surface 40*b.* A punch 50 is pressed upon the top flat surface 40*a* of the tape cast green ceramic member 40 and another series of parallel channels 64 are embossed as shown in FIG. 1*c.* Referring to FIG 1*c,* the next steps involved debinding at about 450° C. to remove most of the organic additives, followed by sintering at about 1200° C. in air for about 2 hours and obtain a highly dense sintered ceramic channel member 60.

Figure 2:
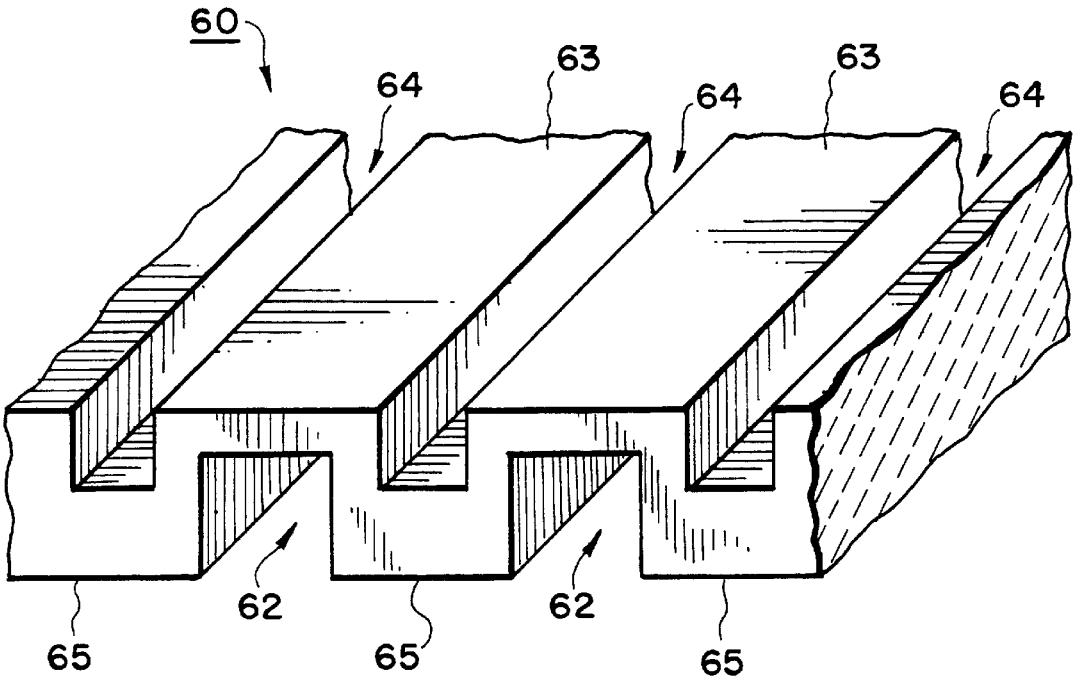
FIG. 2 is an enlarged partial isometric view of the channel member

Referring to FIG. 2, a partial isometric view of the sintered piezoelectric ceramic channel member 60 is shown. A series of micro-sized parallel channels 62 that are formed by the tape casting process, as illustrated in FIG. 1A, are used as ink channels. The width of each channel may vary from 100 to 500 $\mu$m and the height may vary from 100 to 1000 $\mu$m. The micro-sized channels 64 formed by embossing help create parallel walls in each ink channel 62 so that each channel 62 can be individually addressed and actuated to expel the ink to the receiver. The width of the channels 64 may vary from 50 to 200 $\mu$m and the depth of the channels 64 may vary from 50 to 300 $\mu$m. Two heavy duty electrodes in the form of metal plates are placed on parallel first and second surfaces 63 and 65, respectively, clamped tightly, immersed in a bath of oil having high dielectric constant (1,000 to 2500) and a very high voltage is applied across the electrodes to pole the piezoelectric ceramic material along the thickness of the ceramic channel member 60. The reason for selecting high dielectric oil during poling is that the applied electric field is not distorted and the ceramic channel member 60 is poled uniformly.

Figure 3:
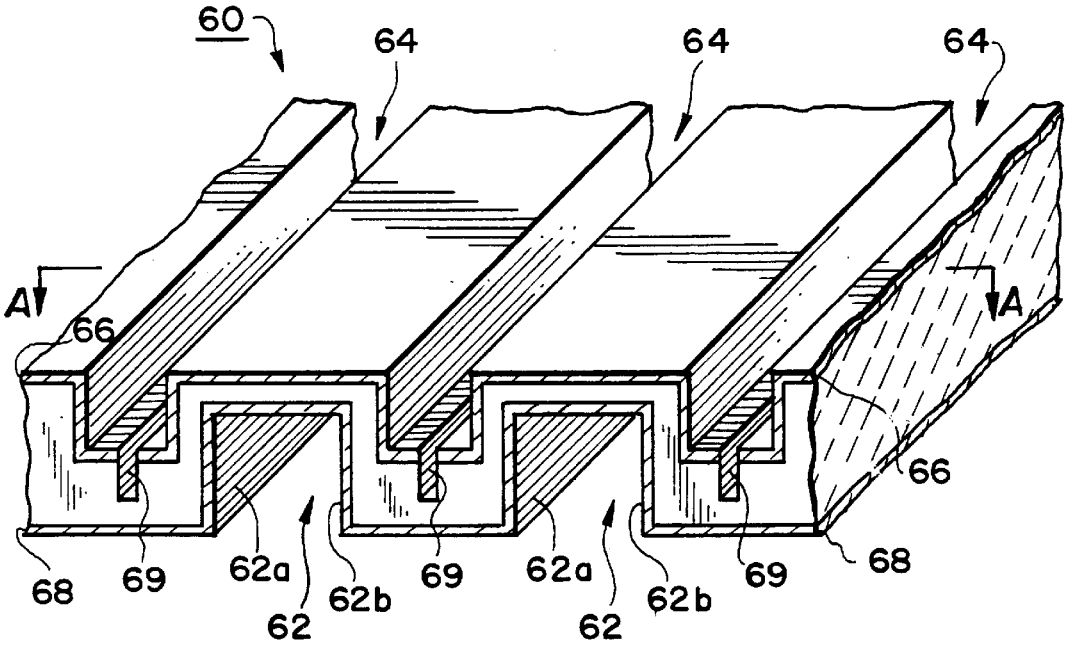
FIG. 3 is an enlarged partial isometric view of the channel member after grooves have been cut.

Referring to FIG. 3, a partial isometric view of the ceramic piezoelectric channel member 60 is show wherein electrically conductive coatings 66 and 68 have been deposited on both the parallel first and second surfaces 63 and 65, respectively. The row of top channels 64 are then cut with a saw or laser to form grooves or narrow channels 69 which help electrically separating each ink channel 62 from each other. These grooves 69 help improve the flexibility of the side walls 62*a* and 62*b* of the ink channels 62 for ease of ink ejection.

Figure 4:
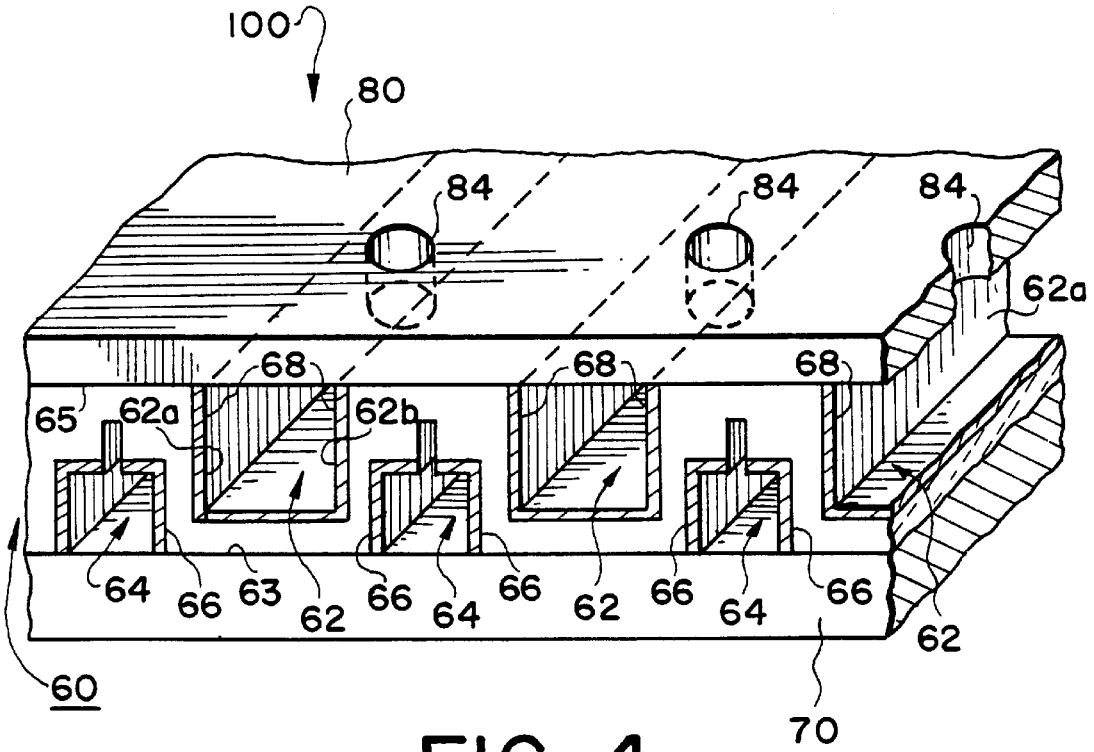
FIG. 4 is an enlarged partial isometric view of a completed ceramic piezoelectric printhead having a channel member and orifice plate.

Referring to FIG. 4, a partial isometric view of an assembled ink jet ceramic piezoelectric printhead 100 according to the present invention is shown. The first surface 63 of the ceramic piezoelectric channel member 60 is bonded with a base plate 70 and the second surface 65 of the ceramic piezoelectric channel member 60 is bonded with an orifice plate 80 in which a row of orifices 84 is aligned with the open end of the ink channel 62. The electrodes 66 and 68 on the opposite sides of the walls 62*a* and 62*b* are electrically connected such that a microprocessor can address each ink channel 62 individually to cause the inward deflection and expel ink droplets to the receiver.

In view of the above description, it is understood that modifications and improvements will take place to those skilled in the art which are well within the scope of this invention. The above description is intended to be exemplary only wherein the scope of this invention is defined by the following claims and their equivalents.

PARTS LIST

10 ceramic slurry
20 mold
30 platen
40 piezoelectric ceramic member
40*a* top surface
40*b* bottom surface
50 punch/embossing punch
60 piezoelectric ceramic channel
62 ink channel
62*a* ink channel side wall
62*b* ink channel side wall
63 first surface
64 channel

65 second surface
66 metal electrode
68 metal electrode
69 channel
70 base plate
80 orifice plate
84 orifice
100 ceramic piezoelectric printhead
A tape casting process
B embossing process
C debinding and sintering process

What is claimed is:

1. A method of making a printhead comprising the steps of:

(a) forming a channel member by providing a mold having a top portion having peaks and valleys:

(i) tape casting a slurry of piezoelectric material into the mold and onto the peaks and valleys of the top portion of the mold to form a tape cast member having a bottom surface with peaks and valleys and a flat top surface;

(ii) removing the tape cast member;

(iii) embossing the top surface of the tape cast member so as to provide peaks and valleys in opposite sides of the tape cast member wherein the valleys in the top surface are disposed in an offset relationship to the peaks in the bottom surface and sintering the embossed tape cast member;

(iv) polling the sintered tape cast member to align the electrical dipoles within the piezoelectric material; and (v) forming a coating of conductive material over the top and bottom surfaces of the sintered tape cast member and then cutting grooves through conductive coating into the top surface in the valleys of the sintered tape cast member to form a channel member; and (b) providing an orifice plate over top surface of the channel member and a substrate over the bottom surface of the channel member.

2. The method of claim 1 wherein the tape casting step further includes:

(i') pouring a slurry of piezoelectric and multi-component binders into the mold; and (ii') drying the slurry.

3. The method of claim 1 wherein the coating material is selected from the group consisting of gold, silver, chromium, aluminum or alloys thereof.

* * * * *